US009052690B2

(12) United States Patent
Udagawa

(10) Patent No.: US 9,052,690 B2
(45) Date of Patent: Jun. 9, 2015

(54) IMAGE FORMING APPARATUS

(71) Applicant: Oki Data Corporation, Tokyo (JP)

(72) Inventor: Hiroshi Udagawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/097,642

(22) Filed: Dec. 5, 2013

(65) Prior Publication Data

US 2014/0161481 A1 Jun. 12, 2014

(30) Foreign Application Priority Data

Dec. 7, 2012 (JP) ..... 2012-268010

(51) Int. Cl.
*G03G 21/20* (2006.01)

(52) U.S. Cl.
CPC ..... *G03G 21/206* (2013.01)

(58) Field of Classification Search
CPC ..... G03G 15/2025; G03G 15/235; G03G 2215/0129; G03G 15/0867; G03G 15/101; G03G 15/2003; G03G 15/2085; G03G 15/23; G03G 15/6529; G03G 15/70; G03G 21/206; G03G 2215/1666
See application file for complete search history.

(56) References Cited

U.S. PATENT DOCUMENTS

2007/0059024 A1* 3/2007 Kitayama ..... 399/92
2007/0280721 A1* 12/2007 Kanai ..... 399/92
2011/0097102 A1* 4/2011 Koshida ..... 399/92

FOREIGN PATENT DOCUMENTS

JP 2008-249888 A 10/2008

* cited by examiner

*Primary Examiner* — Roy Y Yi
(74) *Attorney, Agent, or Firm* — Muncy, Geissler, Olds & Lowe, P.C.

(57) ABSTRACT

An image forming apparatus includes a transfer unit configured to transfer a formed image that is formed by an image forming portion to sheet, a first carrying path configured to guide the sheet in a set direction, a fixing unit configured to fix the formed image to the sheet that is guided by the first carrying path, a second carrying path configured to guide the sheet that is fixed by the fixing unit in a set direction, a communicating unit configured to communicate between the first carrying path and the second carrying path, a first air flowing unit configured to flow air from the first carrying path to the second carrying path, an ejection unit configured to vent the air in the second carrying path to outside.

18 Claims, 10 Drawing Sheets

IMAGE FORMING APPARATUS

This application claims priority under 35 U.S.C. §119 from Japanese Patent Application No. P 2012-268010, filed on Dec. 7, 2012, the disclosure of which is incorporated herein by reference.

BACKGROUND OF THE INVENTION

1. Field of the Invention

This application relates to an image forming apparatus.

2. Description of Related Art

In an image forming apparatus such as a copier, a printer, a facsimile or the like, processes to form images may be described below. An exposure unit exposes a surface of a photoreceptor based on an image data to form an electrostatic latent image after the exposure unit charges the photoreceptor as a latent image carrier. Next, the electrostatic latent image is developed with toner into a toner image. The resulting toner image is transferred directly or via an intermediate transfer body to a sheet such as a printing medium or a film. Finally, a fixing part fuses and fix the toner image to a sheet.

Japanese patent publication 2008-249888 describes the image forming apparatus includes a cooling fan to cool an inside of the image forming apparatus down by emitting heat into the outside. When the fixing part fuses the toner image to the sheet(s), moisture generates from a printing medium. The cooling fan emits moisture above the fixing part. However, the air by the cooling fan cannot reach to guides that are located under the fixing part directly, and moisture accumulates on the guides. As a result, condensation forms on the guides.

SUMMARY OF THE INVENTION

It is therefore an object of the present invention to provide an image forming apparatus that prevents the problems of the conventional art.

In an embodiment, the present invention provides an image forming apparatus that includes a transfer unit configured to transfer a formed image that is formed by an image forming portion to a sheet, a first carrying path configured to guide the sheet in a set direction, a fixing unit configured to fix the formed image to the sheet that is guided by the first carrying path, a second carrying path configured to guide the sheet that is fixed by the fixing unit in a set direction, a communicating unit configured to communicate between the first carrying path and the second carrying path, a first air flowing unit configured to flow air from the first carrying path to the second carrying path, and an ejection unit configured to vent the air in the second carrying path to outside.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
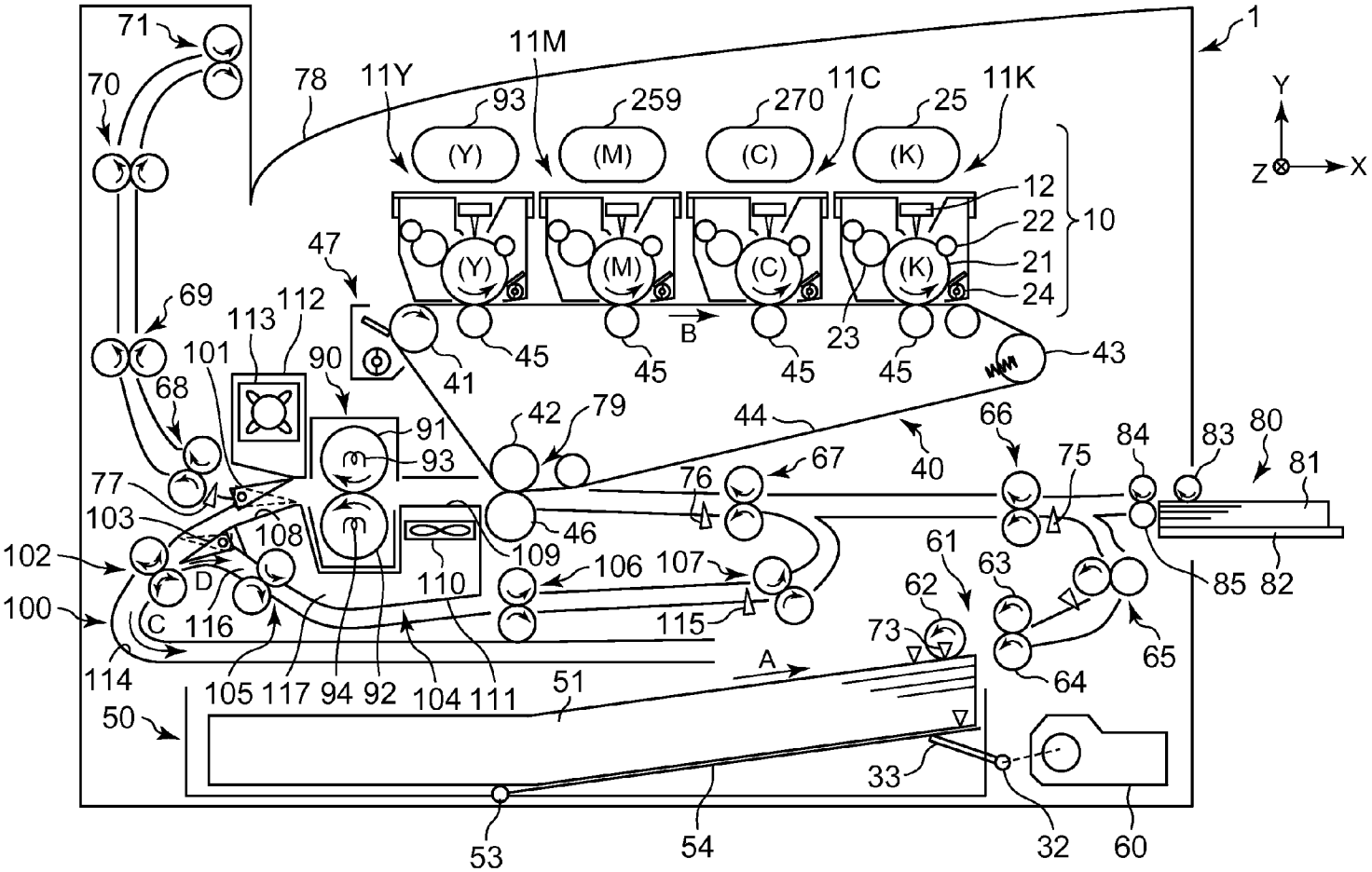
FIG. 1 is a schematic view showing the configuration of an image forming apparatus according to a first illustrative embodiment.

Embodiments of the information processing system will be described with reference to FIGS. 1 to 10 of the drawings, in which like elements are indicated by like reference characters. In the drawings, configurations, positional relations, dimensions, and alignments of elements of the device are illustrated generally for understanding the embodiments and are only intended to facilitate understanding. Described numerical values are merely exemplary. In the drawings, common elements of structures may be designated by the same reference characters, and an explanation thereof is occasionally omitted. Accordingly, embodiments are in no way limited to those illustrated.

An exemplary embodiment of an image forming apparatus is shown FIG. 1. The image forming apparatus 1 in FIG. 1 may include a medium feeding cassette 50 that is removably inserted (i.e., detachably mounted) into the image forming apparatus 1. The medium feeding cassette 50 may store a plurality of recording medium (i.e., printing sheets) 51, and may include a placing plate 54 swingably supported by a shaft 53. A stack of the recording medium 51 is placed on the placing plate 54. A swingable lift-up lever 33 is provided on a feeding side (i.e., a right side in FIG. 1) of the medium feeding cassette 50. The lift-up lever 33 is mounted to a swinging shaft 32. The swinging shaft 32 is disconnectably connected to a motor 60 provided in the main body of the image forming apparatus 1.

The motor 60 causes the lift-up lever 33 to swing upward, and an end of the lift-up lever 33 pushes the placing plate 54 upward. As the placing plate 54 is pushed upward, the stack of the recording medium 51 placed on the placing plate 54 moves upward. A pickup roller 62 is disposed at a position where the pickup roller 62 contacts an upper surface of the recording medium 51 placed on the placing plate 54 pushed upward by the lift-up lever 33. Further, an upward movement detector 73 is provided for detecting that the stacked recording medium 51 reach a height where the upper surface of the recording medium 51 contacts the pickup roller 62. When the upward movement detector 73 detects that the stacked recording medium 51 reach the height where the upper surface of the stacked recording medium 51 contacts the pickup roller 62, the control unit (not shown) causes the motor 60 to stop rotation. A medium feeding part 61 may include a feed roller 63 and a retard roller 64. The feed roller 63 and the retard roller 64 are provided on a feeding side (i.e., a right side in FIG. 1) of the pickup roller 62. The feed roller 63 and the retard roller 64 may contact each other.

The pickup roller 62 and the feed roller 63 may be driven by motor(s) (not shown) to rotate in a direction shown by an arrow in FIG. 1. The pickup roller 62 and the feed roller 63 may include an one way clutch mechanism (not shown), thus the pickup roller 62 and the feed roller 63 rotate idly in the direction shown by the arrow even though the driving by the motor(s) stops. The retard roller 64 generates a force in a direction shown by an arrow by means of a torque-generator (not shown). The feed roller 63 and the retard roller 64 may separate the stocked recording media into each single medium 51, even though the pickup roller 62 draws a few recording medium 51 at once.

The pairs of conveying rollers 65, 66, and 67 are provided on a downstream side of the medium feeding part 61 in a feeding direction A for the recording medium 51. The conveying rollers 65 convey the recording medium 51 while correcting a skew of the recording medium 51. The conveying rollers 66 and 67 convey the recording medium 51 to a second transfer part 79. A sheet sensor 75 is provided on an upstream side of the conveying rollers 65. The sheet sensor 75 may detect passage of the recording medium 51 to decide next driving timing of the conveying rollers 66. A writing sensor 76 is provided on a downstream side of the conveying rollers 51. The wiring sensor 76 detects passage of the recording medium 51 for determining timing to start exposure (i.e., writing) in the image forming portion 10. The pairs of conveying rollers 65, 66, and 67 are driven by drive source (not shown) to rotate.

An MPT (Multi-Purpose Tray) 80 is provided on a side surface (i.e., a right surface in FIG. 1) of the image forming apparatus 1. The MPT 80 may include a placing plate 82 on which a stack of recording medium 81 is placed. The MPT 80 further may include a pickup roller 83 for picking up the recording medium 81 from the stack placed on the placing plate 82. An upper surface of the stacked recording medium 81 on the placing plate 82 contacts the pickup roller 83. A feed roller 84 and a retard roller 85 are provided on a feeding side (i.e., a left side in FIG. 1) of the pickup roller 83. The feed roller 84 and the retard roller 85 contact each other. The feed roller 84 and the retard roller 85 may separate the recording medium 81 (drawn by the pickup roller 83) into each single medium 81, and feed the medium 81 toward a carrying path in the main body of the image forming apparatus 1.

The image forming portion 10 includes process units (i.e., image forming units) 11Y, 11M, 11C, and 11K that respectively form images of yellow, magenta cyan, and black. The process units 11Y, 11M, 11C, and 11K are arranged in this order from an upstream side toward a downstream side along the feeding direction of the medium 51. Each of the process units 11Y, 11M, 11C, and 11K may be detachably mounted to the main body of the image forming apparatus 1.

Each of the process units 11Y, 11M, 11C, and 11K may have same internal configuration. Here, a configuration of the process unit 11K will be described. The process unit 11K includes a photosensitive drum 21 as a latent image bearing body. The photosensitive drum 21 has a cylindrical shape and is rotatable in a direction shown by an arrow. The photosensitive drum 21 has a surface capable of holding an electric charge to bear a latent image. Along a circumference of the photosensitive drum 21, a charging roller 22, an exposure device 12, a developing roller 23, and a cleaning blade 24 are provided in this order in a rotational direction of the photosensitive drum 21. The charging roller (i.e., a charging member) 22 is configured to uniformly charge the surface of the photosensitive drum 21. The exposure device 12 is configured to selectively emit light to the surface of the photosensitive drum 21 to thereby form a latent image. The developing roller (i.e., a developer bearing body) 23 is configured to develop the latent image on the surface of the photosensitive drum 21 using a black toner (i.e., a developer). The cleaning member 24 is configured to remove a residual toner that remains on the surface of the photosensitive drum 21. A toner storage unit 25K (for example, a toner cartridge) is provided on an upper part of the process unit 11K. The photosensitive drum 21 and these rollers 22, 23 are driven by drive source (not shown) to rotate.

A transfer unit 40 is provided below the process units 11Y, 11M, 11C, and 11K. The transfer unit 40 includes four transfer rollers 45 (i.e., transfer members) respectively pressed against the photosensitive drums 21 of the process units 11Y, 11M, 11C, and 11K. Each transfer roller 45 is applied with a transfer voltage, so as to create a potential difference between a surface potential of the transfer roller 45 and a surface potential of the photosensitive drum 21. A transfer belt 44 is provided through between the respective photosensitive drums 21 and the transfer rollers 45. The transfer belt 44 is stretched around a driving roller 41 a second backup roller 42 that faces a second transfer roller 46, and a tension roller 43. The driving roller 41 is driven by drive source (not shown) to rotate. The tension roller 43 applies tension to the transfer belt 44. A cleaning blade 47 may be provided on a transfer belt 44. The cleaning blade 47 scrapes off (i.e., removes) the toner adhering to the surface of the transfer belt 44.

A toner image that is formed by the image forming portion 10 is transferred to the transfer belt 44, and the toner image on the transfer belt 44 is transferred to the recording medium 51 or 81.

A fixing unit 90 may be provided on a downstream side of the image forming portion 10. The fixing unit 90 includes an upper roller 91 and a lower roller 92. The upper roller 91 has a halogen lamp 93 therein as a heat source. The lower roller 92 has a halogen lamp 94 therein as a heat source. The upper roller 91 and the lower roller 92 of the fixing unit 90 apply heat and pressure to the toner image on the medium 51 or 81 (fed from the image forming portion 10) to thereby cause the toner to be molten and fixed to the medium 51 or 81.

Ejection rollers 68, 69, 70, and 71 are provided on a downstream side of the fixing unit 90 in the feeding direction of the recording medium 51. The ejection rollers 68, 69, 70, and 71 are configured to eject the recording medium 51. A stacker portion 78 is provided on an upper cover of the image forming apparatus 1. The ejected medium 51 is placed on the stacker portion 78. An ejection sensor 77 is provided on an upstream side of the ejection rollers 68, 69, 70, and 71. The ejection sensor 77 detects passage of the medium 51 for determining timings to start rotating the ejection rollers 68, 69, 70, and 71. When the recording medium 51 is ejected by the ejection rollers 68, 69, 70, and 71, the ejection separator 101 may be set at an ejecting position that is drawn by broken lines.

When the image forming apparatus 1 performs the double sided printing, the ejection separator 101 may turn to set at a double sided printing position that is drawn a solid line in FIG. 1. Thus, the record medium 51 that is printed at single side is led to a double sided print carrying part 100.

A pair of inversion rollers 102, an inversion separator 103, a pair of conveying rollers 105, a pair of horizontal rollers 106, a pair of re-feed rollers 107, and a re-supplying sensor 115 are provided on the double sided print carrying part 100. The pair of inversion rollers 102 transports recording medium 51 into or out a retreating part 114 to turn back in an opposite direction and to be redirected, so that the front and back of the recording medium 51 is reversed. The pair of conveying rollers 105 leads the recording medium 51 to a double sided printing guide part 111. The pair of horizontal rollers 106 carries horizontally the record medium 51 along an inversion carrying path 116. The re-supplying sensor 115 checks timing for re-supplying the record medium 51. The pair of re-supplying rollers 107 carries the recording medium 51 to the pair of conveying rollers 67 to perform the double sided printing.

The pair of inversion rollers 102, conveying rollers 105, horizontal rollers 106, and re-supplying rollers 107 are driven by drive source (not shown) to rotate. The ejection separator 101 and the inversion separator 103 are transmitted to set the position by transmit source (not shown), for example, solenoid.

When the ejection separator 101 sets at the double sided printing position, and the inversion separator 103 sets at a carrying out position that is drawn a solid line in FIG. 1, the pair of inversion rollers 102 rotates in the direction of carrying the medium 51 out (clockwise direction), and the medium 51 is carried in the direction shown by an arrow "C" and is carried to the retreating part 114 in the order of leading edge to trailing edge. Next, when the trailing edge of the medium 51 has passed, and the inversion separator 103 may detect the pass of the trailing edge, the pair of inversion rollers 102 rotate in a direction of carrying the medium 51 in (counter-clockwise direction), and the inversion separator 103 sets at the carrying out position that is drawn by broken lines.

The recording medium 51 in the retreating part 114 is turned back in an opposite direction (shown by an arrow "D"), and the recording medium 51 is carried along an inversion carrying path 116 in the opposite direction. When the pair of conveying rollers 67 carries the recording medium 51, a printing side of the recording medium 51 is a top side, so a back side has been printed. And, the printing of the second side is performed for the recording medium 51. The printing of the second side is same to the first side. In this situation, the ejection separator 101 sets at the ejecting position, and the recording medium 51 that has been performed the double sided printing is ejected to the stacker portion 78.

In FIG. 1, an X-direction in which the transfer belt 44 passes through the process unit 11 is expressed as a carrying direction (shown by an arrow "B"). A direction to an axis direction of the photosensitive drum 21 is defined as a Z-direction. A direction perpendicular to both of the X-direction and the Z-direction is defined as a Y-direction. Hereinafter, an X-direction, a Y-direction and a Z-direction in FIGS. 2 to 10 are defined in the same way as the X-direction, the Y-direction and the Z-direction in FIG. 1.

Figure 2:
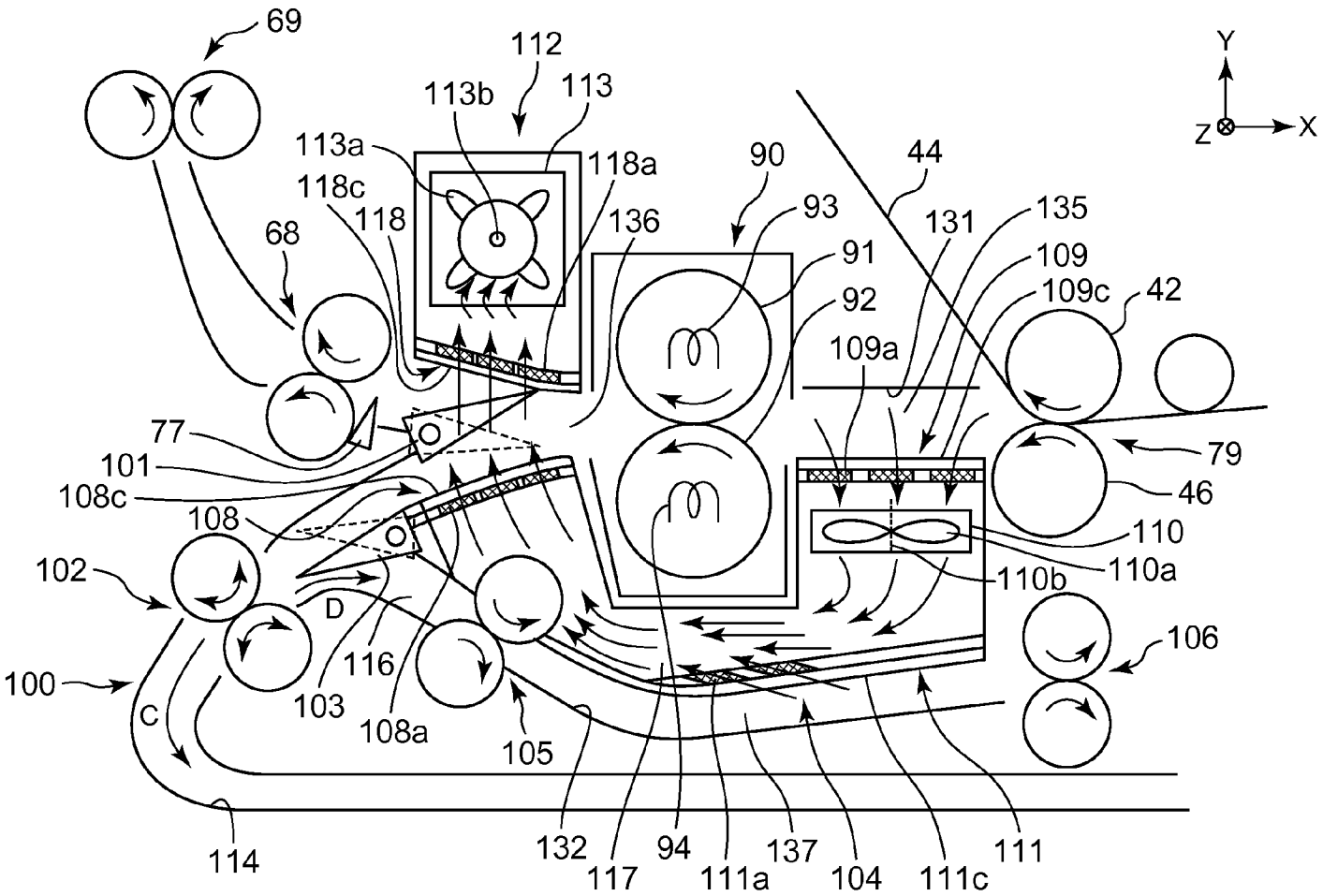
FIG. 2 is an enlarged view of the fuser part and the double sided printing mechanism in FIG. 1.

As shown in FIG. 2, a transferring guide part 109 and an upper surface transferring guide part 131 are provided at a downstream side of the second transferring part 79 in the X-direction. The transferring guide part 109 is opposed to the upper surface transferring guide part 131. A first carrying path 135 includes the transferring guide part 109 and the upper surface transferring guide part 131. The transferring guide part 109 leads the recording medium 51 to the fixing unit 90. The pair of conveying rollers 105, a fixing guide part 108, and the double sided printing guide part 111 are provided at a downstream side of the fixing unit 90. The fixing guide part 108 leads the recording medium 51 to the inversion separator 103. The pair of conveying rollers 105 carries the recording medium 51 along the inversion carrying path 116 in the direction of the arrow D. The double sided printing guide part 111 leads the recording medium 51 to the pair of horizontal rollers 106. A third carrying path 137 includes the double sided printing guide part 111 and the downside double sided printing guide part 132.

Figure 3:
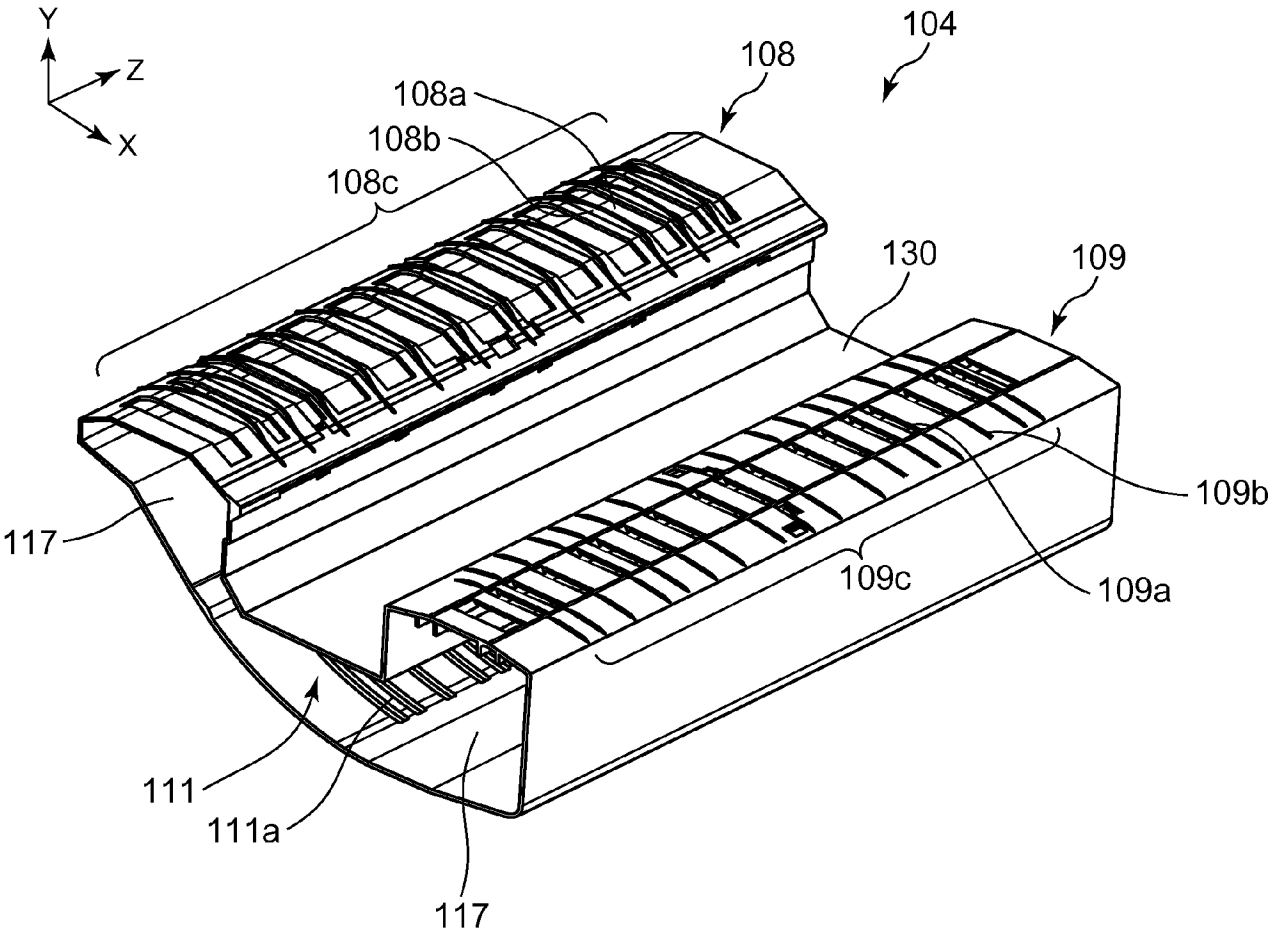
FIG. 3 is a perspective view showing a carrying guide.

As shown in FIG. 3, a carrying guide part 104 includes the fixing guide part 108, the transferring guide part 109, the double sided printing guide part 111, and a duct 117. The fixing guide part 108 has hole(s) 108*a* which the air flows for, the transferring guide part 109 has hole(s) 109*a* which the air flows for, and the double sided printing guide part 111 has hole(s) 111*a* which the air flows for. The air in the duct 117 flows through the hole(s) 108*a*, 109*a*, and 111*a*. A communicating unit may include the hole(s) 108*a*, 109*a*, and the duct 117.

A suction fan 110 is provided on around the transferring guide part 109. The suction fan 110 sucks air through the hole(s) 109*a* to pull in the recording medium 51 above the transferring guide part 109. Thus, the suction fan 110 may avoid floating of the recording medium 51 on the transferring guide part 109. The air that is sucked through the hole(s) 109*a* by the suction fan 110 may flow through the hole(s) 108*a*.

An ejection guide part 112 is provided on upper side of the ejection separator 101. An upper surface guide part 118 and the ejection separator 101 configure a carrying path toward the ejection rollers 68 when the ejection separator 101 sets at the ejecting position (drawn by broken lines in FIG. 2). An ejection fan 113 is provided in the ejection guide part 112. The ejection fan 113 vents the air that flows from hole(s) 118*a* to the outside of the image forming apparatus 1. The upper surface guide part 118 and the fixing guide part 108 also configure a second carrying path 136.

The air from the hole(s) 108*a* flows through the hole(s) 108*a* to the ejection guide part 112, and the air is vented to the outside of the image forming apparatus 1 by the ejection fan 113. The air in the third carrying path 137 is warmed by the heat that the fixing process for the recording medium 51 generates, and the air also flows through the hole(s) 111*a* to the duct 117. Thus, the air that is vented by the ejection fan 113 includes the air from the hole(s) 109*a* and the air from the hole(s) 111*a*.

Next, the ejection separator 101, the carrying guide part 104, and the ejection guide part 112 are described about more detail.

Both sides of the carrying guide part 104 in the direction Z (FIG. 3) may be covered by side walls. Due to the description for convenience, the near side one of the side walls is removed in FIG. 3.

As shown in FIG. 3, the fixing guide part 108 and the transferring guide part 109 are provided on the upper side of the carrying guide part 104, and a concave part 130 is provided between the fixing guide part 108 and the transferring guide part 109. The transferring guide part 109 may be equal to a first lower guide part, and the fixing guide part 108 may be equal to a second lower guide part in this description. The lower roller 92 is provided on the concave part 130. The fixing guide part 108 includes the hole(s) 108*a* and rib(s) 108*b*. The hole(s) 108*a* (the second hole(s)) that may be symmetric shapes are provided at a set interval in the direction "Z" (FIG. 3). Each rib 108*b* is formed in the direction "X" (FIG. 3) among the holes 108*a*. A formed position of rib(s) 108*b* is higher than the hole(s) 108*a*. The upper surfaces of rib(s) 108*b* may be equal to the carrying surface 108*c* (FIG. 2). All of the hole(s) 108*a* is rectangle whose length in the direction "X" may be longer than width in the direction "Z".

The transferring guide part 109 includes the hole(s) 109*a* and rib(s) 109*b*. The hole(s) 109*a* (the first hole(s)) that may be symmetric shapes are provided at a set interval in the direction "Z" (FIG. 3). Each rib 109*b* is formed in the direction "X" (FIG. 3) among the hole(s) 109*a*. A formed position of rib(s) 109*b* is higher than the hole(s) 109*a*. The upper surfaces of rib(s) 109*b* may be equal to the carrying surface 109*c* (FIG. 2). All of the hole(s) 109*a* may be shaped as a slit whose length in the direction "X" may be longer than width in the direction "Z".

Figure 4:
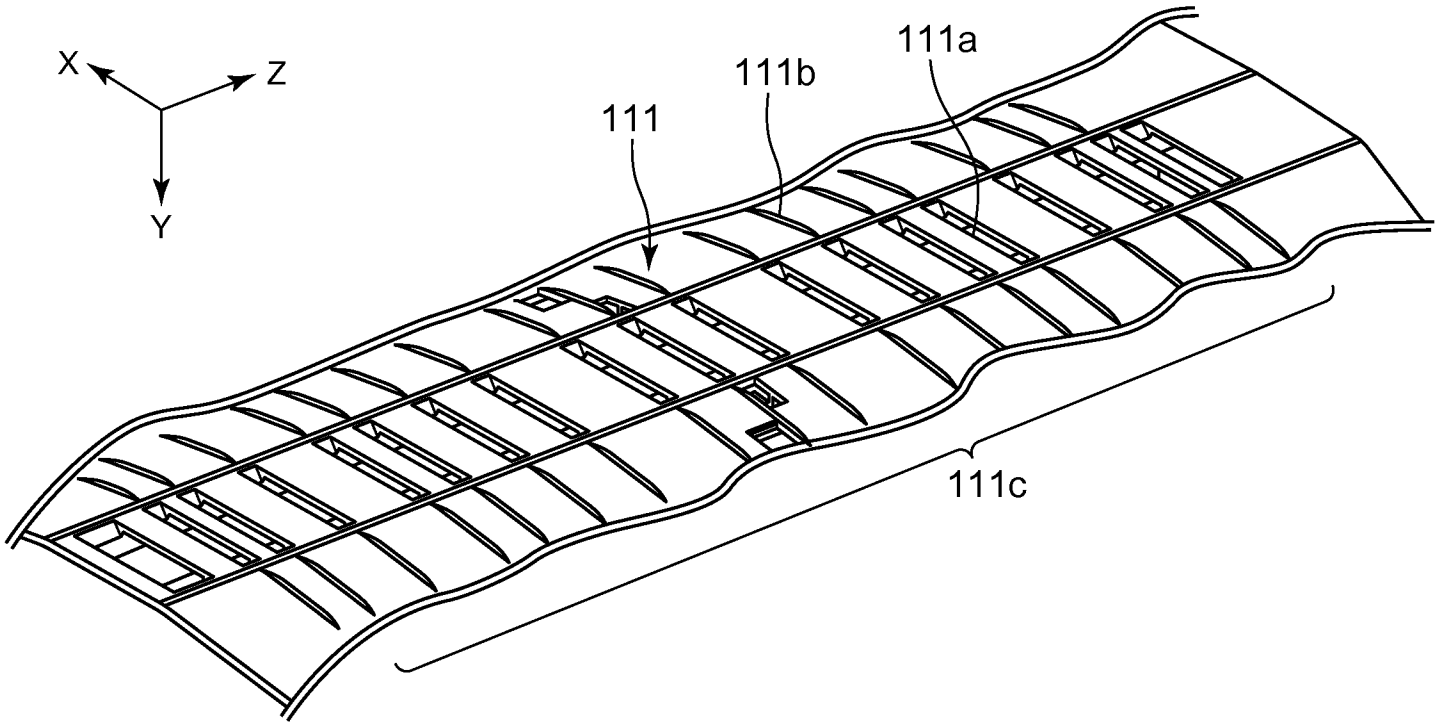
FIG. 4 is a perspective view showing a double sided printing guide in the carrying guide.

As shown in FIGS. 3, and 4, the double sided printing guide part 111 is provided on a lower side of the carrying guide part 104, and the double sided printing guide part 111 includes the hole(s) 111*a* and rib(s) 111*b*. The hole(s) 111*a* (the fourth hole(s)) that may be symmetric shapes are provided at a set interval in the direction "Z" (FIG. 4). Each rib 111*b* is formed in the direction "X" (FIG. 3) among the hole(s) 111*a*. A formed position of rib(s) 111*b* is higher than the hole(s) 111*a*. The upper surfaces of rib(s) 111*b* may be equal to the carrying surface 111*c* (FIG. 2). All of the hole(s) 111*a* is a slit whose length in the direction "X" may be longer than a width in the direction "Z".

The carrying guide part 104 may be symmetrical with respect to a plane that parallels the direction "X".

Figure 5:
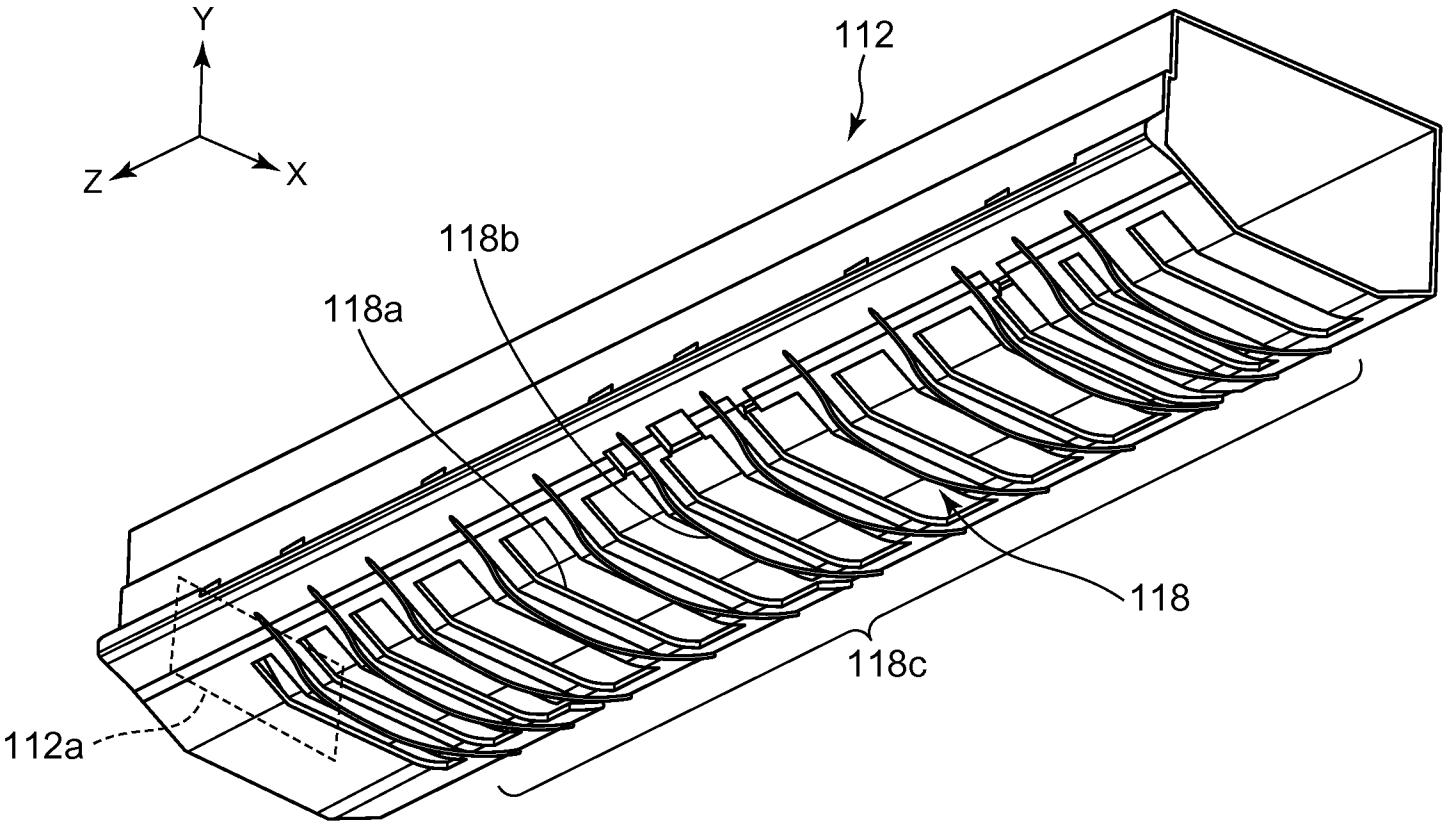
FIG. 5 is a perspective view showing an ejection guide.

FIG. 5 is a perspective view showing the ejection guide part 112 in further detail. Both sides of the ejection guide part 112 in the direction Z (FIG. 5) may be covered by side walls. Due to the description for convenience, the upper side one of the side walls is removed in FIG. 5.

The upper surface guide part 118 is provided on a lower side of the ejection guide part 112, and includes the hole(s) 118*a* and rib(s) 118*b*. The hole(s) 118*a* (the third hole(s)) that may be symmetric shapes are provided at a set interval in the direction "Z" (FIG. 5). Each rib 118*b* is formed in the direction "X" (FIG. 5) between the hole(s) 118*a*. The rib(s) 118*b* of a formed position are higher than the hole(s) 118*a*. The upper surfaces of rib(s) 118*b* are equal to the carrying surface 118*c* (FIG. 2). All of the hole(s) 118*a* can be rectangular whose length in the direction "X" may be longer than a width in the direction "Z".

An aperture part 112*a* is provided on the one side wall of the ejection guide part 112. The aperture part 112*a* vents the air that flows from the hole(s) 118*a*.

A width of an area that is formed hole(s) 108*a*, 109*a*, and 118*a* in the direction "Z" may be wider than the width of the medium 51.

Figure 6:
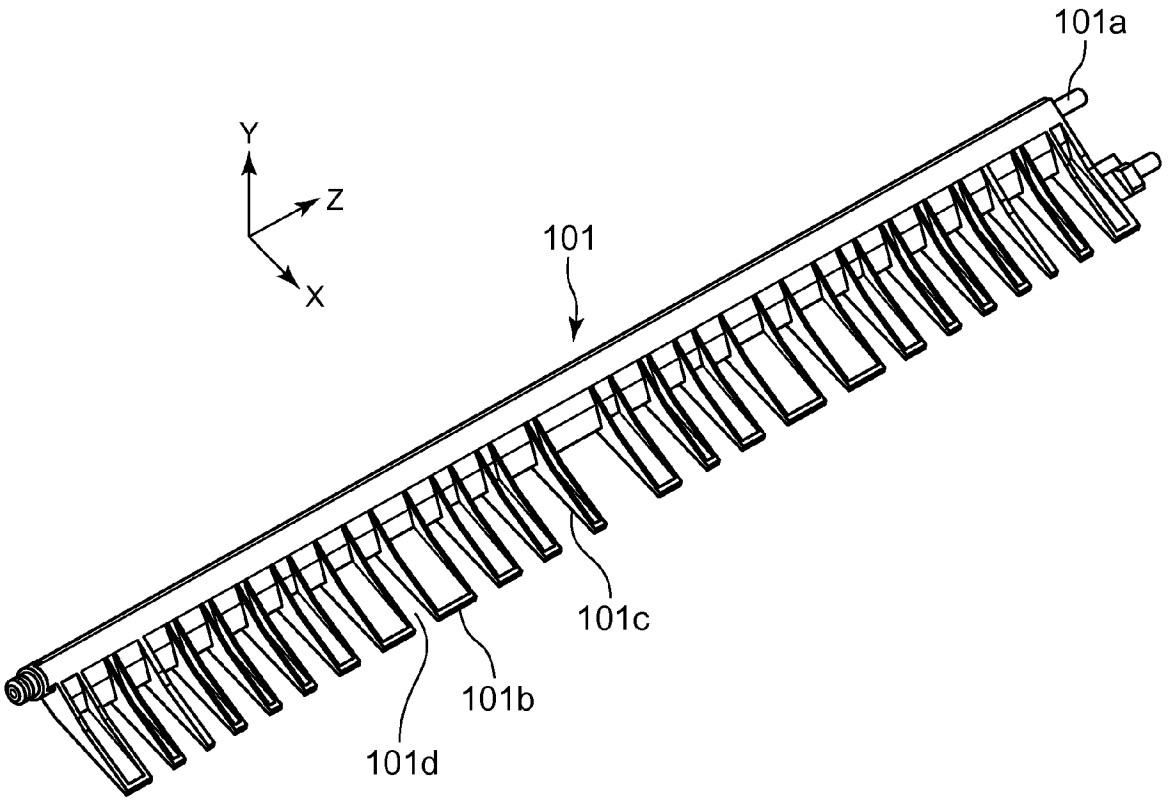
FIG. 6 is a perspective view showing an ejection separator.

As shown in FIG. 6, the ejection separator 101 includes revolving axes 101*a* and guide parts 101*b*. The ejection separator 101 is provided between the fixing guide part 108 and the upper surface guide part 118. Each guide part 101*b* can be formed at a set interval in the direction "Z" (FIG. 6), so that the shape of the guide parts 101*b* is a pectinate shape.

The ejection separator 101 has gaps 101*d* between guide parts 101*b*, and the air flows through the gaps 101*d*. Thus, the air from the hole(s) 108*a* may flow to the ejection fan 113. As shown in FIG. 6, the gaps 101*d* are U-shaped parts, however, the gaps 101*d* are not limited to the U-shaped parts, for example, the gaps 101*d* may be O-shaped parts, and both the O-shaped parts and U-shaped parts.

Next, the suction fan 110 and the ejection fan 113 are described about more detail.

As shown in FIGS. 2 and 3, the suction fan 110 is provided below the carrying surface 109*c*, and there is a set interval between the suction fan 110 and the carrying surface 109*c*. The interval between the suction fan 110 and the carrying surface 109*c* may be preferably range of 8% to 18% of the width of the carrying surface 109*c* in the direction "Z", or 9% to 19% of the maximum width of the recording medium 51 in the direction "Z". The width of the carrying surface 109*c* may be equal to the width of the carrying guide part 104 in the direction "Z" (FIG. 3).

Thus, the suction fan 110 may suck stably the recording medium 51 via the hole(s) 109*a*. A plurality of the hole(s) 109*a* may prevent from large variations of the suction power for the recording medium 51 by the suction fan 110, even though part of holes stops up.

The image forming apparatus 1 includes a suction fan 110 and an ejection fan 113. The suction fan 110 is provided below the carrying surface 109*c* (FIG. 2), and the suction fan 110 is located at the center of the width of the transferring guide part 109 in the direction "Z" (FIGS. 2, 3). The center of the width of the transferring guide part 109 may mean a length between one side edge of the transferring guide part 109 in the direction "Z" (FIGS. 2, 3) and a rotation axis 110*b* of the suction fan 110 is in a range of 40% to 60% of the width of the transferring guide part 109 in the direction "Z" (FIGS. 2, 3), or a length between one side edge of the recording medium 51 in the direction "Z" (FIGS. 2, 3) and a rotation axis of the suction fan 110 is in a range of 40% to 60% of the width of the transferring guide part 109 in the direction "Z" (FIGS. 2, 3).

The ejection fan 113 is provided above the carrying surface 118*c* (FIG. 2), and the ejection fan 113 is located in the ejection guide part 112 so as to vent the air to outside via the aperture part 112*a* (FIG. 5).

A sucking direction of the suction fan 110 crosses the carrying surface 109*c*, so an extended line of the rotation axis 110*b* crosses the carrying surface 109*c*. A direction of ejecting air by the ejection fan 113 may be parallel to the carrying surface 108*c*, so the direction of ejecting air does not cross the carrying surface 108*c*. In other word, the rotation axis 113*b* is parallel to the carrying surface 108*c*.

An air volume of the ejection fan 113 may be larger than the suction fan 110 to stabilize the flow of air between the suction fan 110 and the ejection fan 113. For example, the air volume of the ejection fan 113 may be 0.76 $m^3$/min, and the air volume of the suction fan 110 may be 0.69 $m^3$/min. And, a diameter of the fan blade 110*a* may be equal to a diameter of the fan blade 113*a*, for example the diameter may be a range of 59 mm to 61 mm, and the ejection fan 113 may have a rate of 4850 rounds per minute (4850 rpm), and the suction fan 110 may have a rate of 5400 rpm.

As shown by arrows in FIG. 2, the direction of the airflow by the suction fan 110 and the ejection fan 113 is described in the transferring guide part 109 and the ejection guide part 112. The air around the transferring guide part 109 flows through the hole(s) 109*a* to the duct 117 by the rotation of the suction fan 110, and flows in the duct 117 according to the direction of the arrow. The air that has been heated in the third carrying path 137 by the fixing process for the recording medium 51 also flows through the hole(s) 111*a* to the duct 117. Next, according to the arrows, the air in the duct 117 flows through the hole(s) 108*a* to the second carrying path 136.

The air that flows toward the second carrying path 136 and a vapor flow through the hole(s) 118*a* to the ejection guide part 112. The vapor is generated at the recording medium 51 that is heated highly by the fixing unit 90. Next, the air in the ejection guide part 112 flows through the aperture part 112*a* to the outside of the image forming apparatus 1 via a flow path (not shown).

Figure 7:
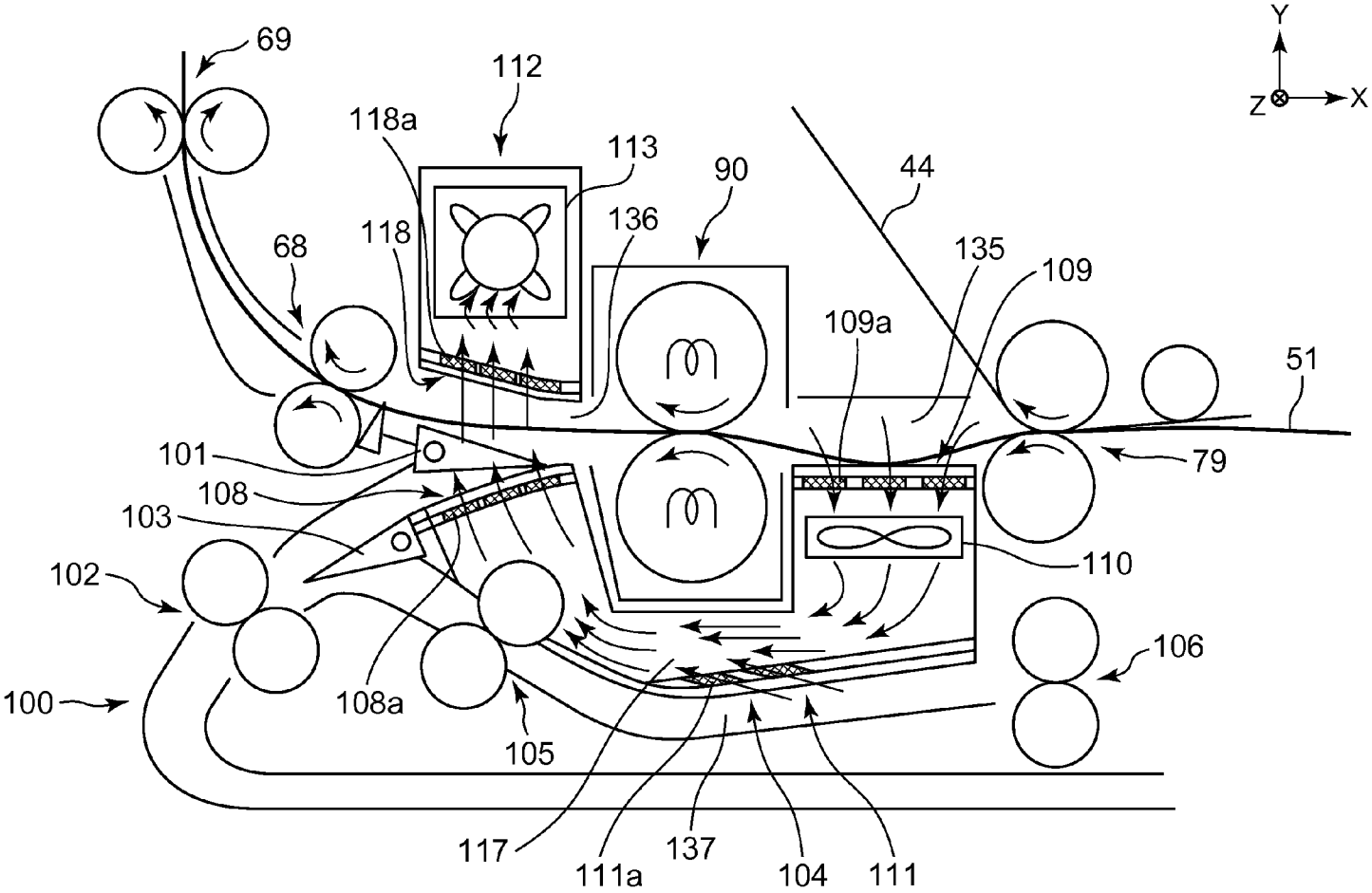
FIG. 7 is an enlarged view of the fuser part and the double sided printing mechanism in FIG. 1 when a recording medium is ejected.

As shown in FIG. 7, the ejection separator 101 is set at the ejecting position. The carrying path for the recording medium 51 that carries toward the ejection rollers 68 is comprised of the ejection separator 101 and the upper surface guide part 118. At this time, the recording medium 51 is sucked toward the transferring guide part 109 by the suction fan 110, so a part of the recording medium 51 contacts on and does not separate from the transferring guide part 109 while the recording medium 51 travels above the transferring guide part 109. When the image forming apparatus does not work, the ejection separator 101 may be set at the ejecting position.

Figure 8:
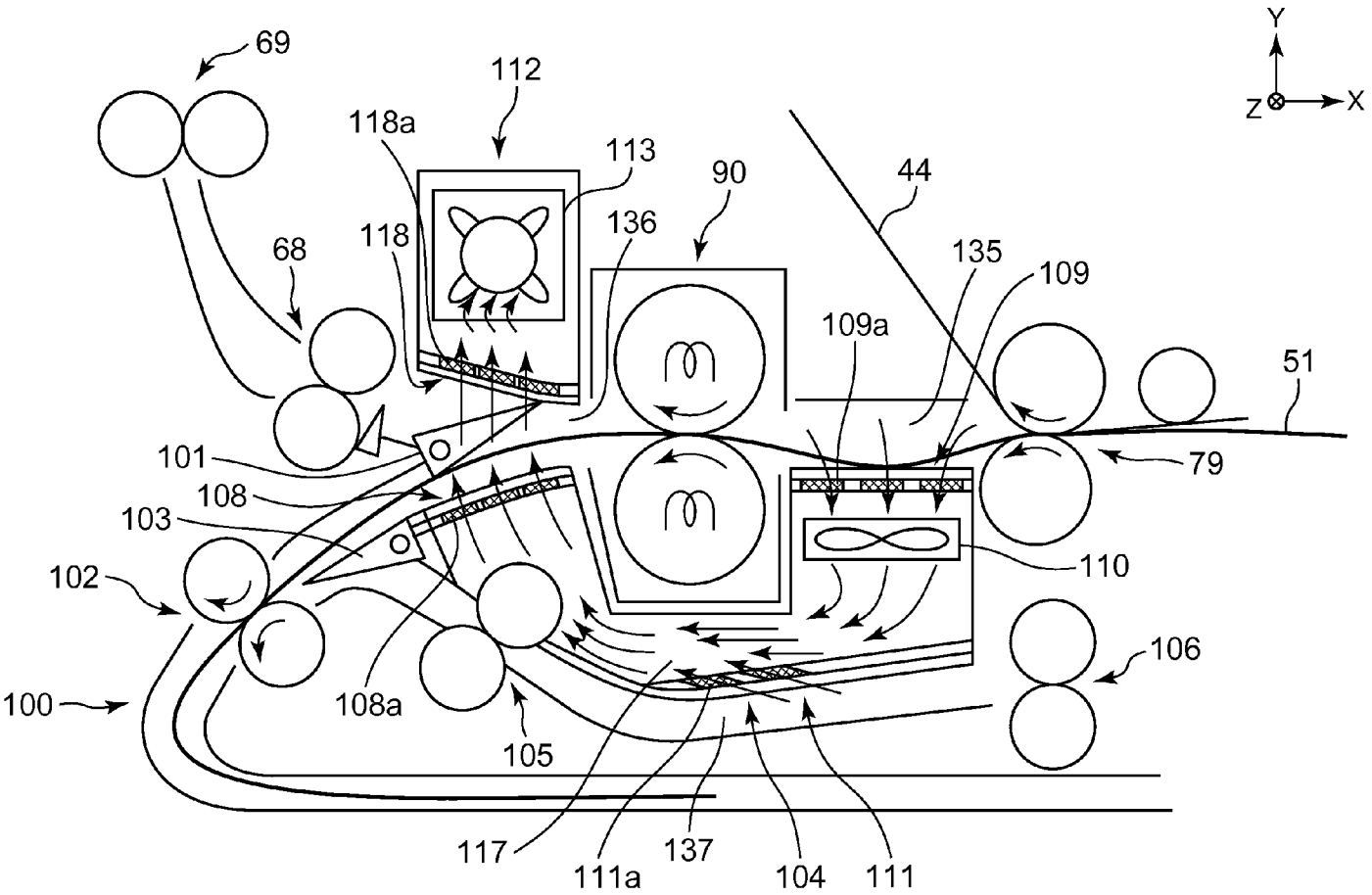
FIG. 8 is an enlarged view of the fuser part and the double sided printing mechanism in FIG. 1 when a recording medium moves to a double sided printing carrying part.

As shown in FIG. 8, the ejection separator 101 turns to set at the double sided printing position. Thus, a carrying path for the recording medium 51 that carries toward the pair of inversion rollers 102 is comprised of the ejection separator 101 and the fixing guide part 108. At this time, the inversion separator 103 is set at a carrying in position to guide the recording medium 51 to the pair of inversion rollers 102.

Figure 9:
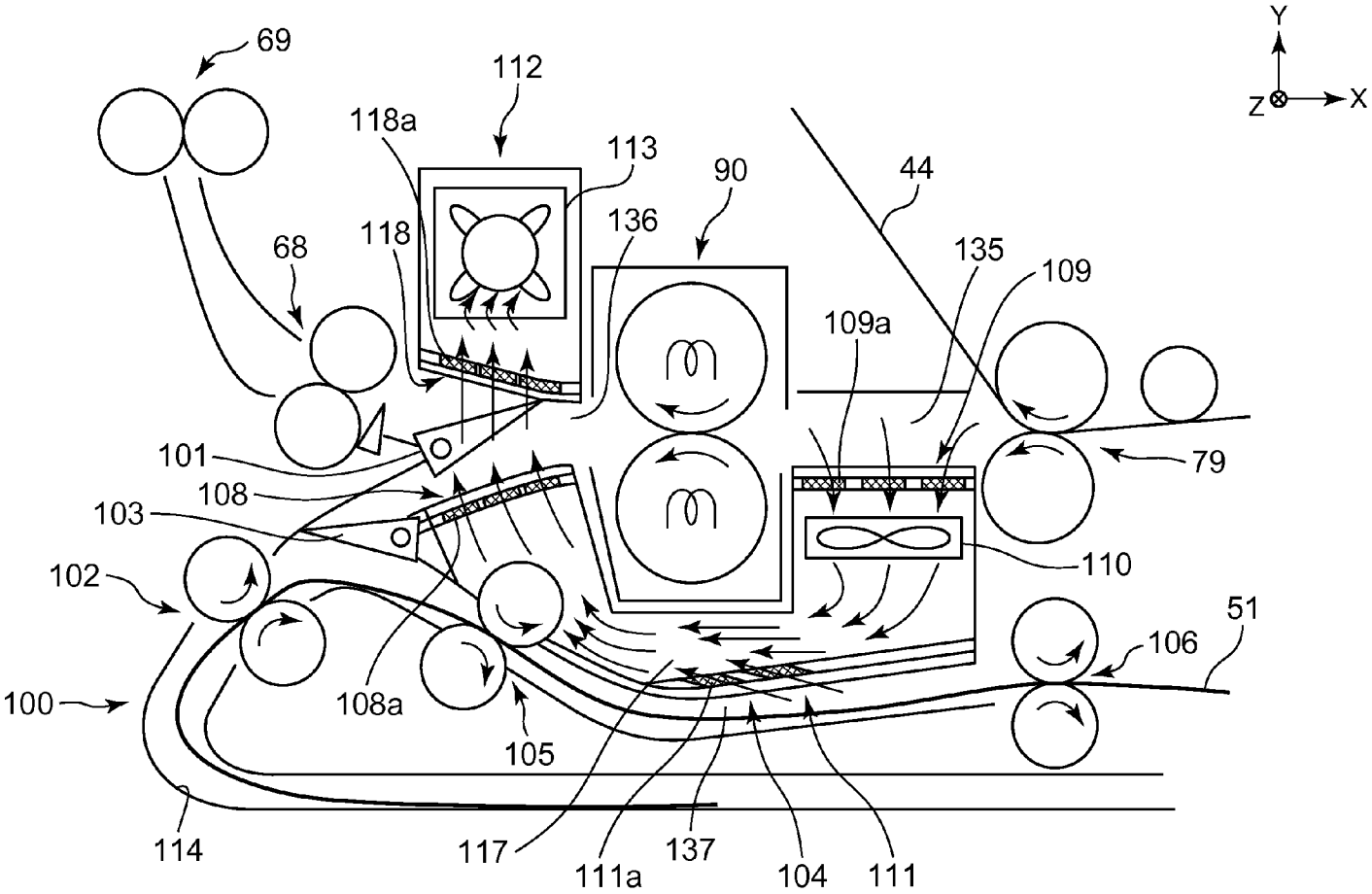
FIG. 9 is an enlarged view of the fuser part and the double sided printing mechanism in FIG. 1 when a recording medium moves to a carrying part in double sided printing mechanism.

As shown in FIG. 9, the inversion separator 103 is set at the carrying out position when a rotation direction of the pair of inversion rollers 102 changes from the carrying in direction to the carrying out direction (clockwise direction). Next, the recording medium 51 that has been carried to the retreating part 114 is carried to the pair of conveying rollers 105 in the opposite direction of forward carrying to the retreating part 114 (FIGS. 8, 9). The inversion separator 103 that is set at the carrying out position guides the recording medium 51 to the pair of conveying rollers 105.

As shown in FIGS. 7 to 9, the suction fan 110 is provided below the carrying surface 109*c*, and there is a set interval between the suction fan 110 and the carrying surface 109*c*. And more, the width of location area of the hole(s) 109*a* is wider than the width of the recording medium 51 in the direction "Z". Thus, the air flows through the hole(s) 109*a* to the duct 117 although the recording medium 51 travels on the transferring guide part 109.

The width of location area of the hole(s) 108 is also wider than the width of the recording medium 51 in the direction "Z". Thus, the air in the duct 117 flows through the hole(s) 108*a* to the ejection guide part 112 although the recording medium 51 travels on the fixing guide part 108.

The width of location area of the hole(s) 118*a* is also wider than the width of the recording medium 51 in the direction "Z". Thus, the air in the ejection guide part 112 flows through the hole(s) 108*a* to the ejection guide part 112 although the recording medium 51 travels on the upper surface guide part 118.

Each carrying surface 108*c*, 109*c*, and 118*c* are comprised of each of the rib(s) 108*b*, 109*b*, and 118*b* whose formed position is higher than the formed position of the hole(s) 108*a*, 109*a*, and 118*a*. Thus, the air easily flows through the hole(s) 108*a*, 109*a*, and 118*a* although the recording medium 51 passes through the fixing guide part 108, the transferring guide part 109, and the upper surface guide part 118.

As described above, the suction fan 110 is located upstream of the carrying path in the fixing process by the fixing unit 90, and the ejection fan 113 is located downstream. The suction fan 110 sucks the air around the upstream, and the air flows through the duct 117 to the fixing guide part 108. Next, the ejection fan 113 vents the air that flows from hole(s) 118*a* in the downstream to the outside of the image forming apparatus 1. Thus, the airflow from the upstream (the first carrying path 135) to the downstream (the second carrying path 136) is made.

As a result of the airflow that is made, the image forming apparatus 1 may improve stable traveling for the recording medium 51 in the first carrying path 135, and may exhaust heat in the third carrying path 137. The image forming apparatus 1 also vents the air that includes vapor in the second carrying path 136 to an exterior of the image forming apparatus 1 via the suction fan 110 and the ejection fan 113. Thus, the image forming apparatus 1 prevents condensation and is cooled.

And, while the suction fan 110 and/or the ejection fan 113 work, the image forming apparatus 1 always vents the air to an exterior of the image forming apparatus 1. Thus, even though an internal temperature of the image forming apparatus 1 and a surrounding temperature of the fixing unit 90 do not rise, the image forming apparatus 1 may stop condensation, shorten the first printing time, and/or improve working speed and consumed power of the image forming apparatus 1.

Figure 10:
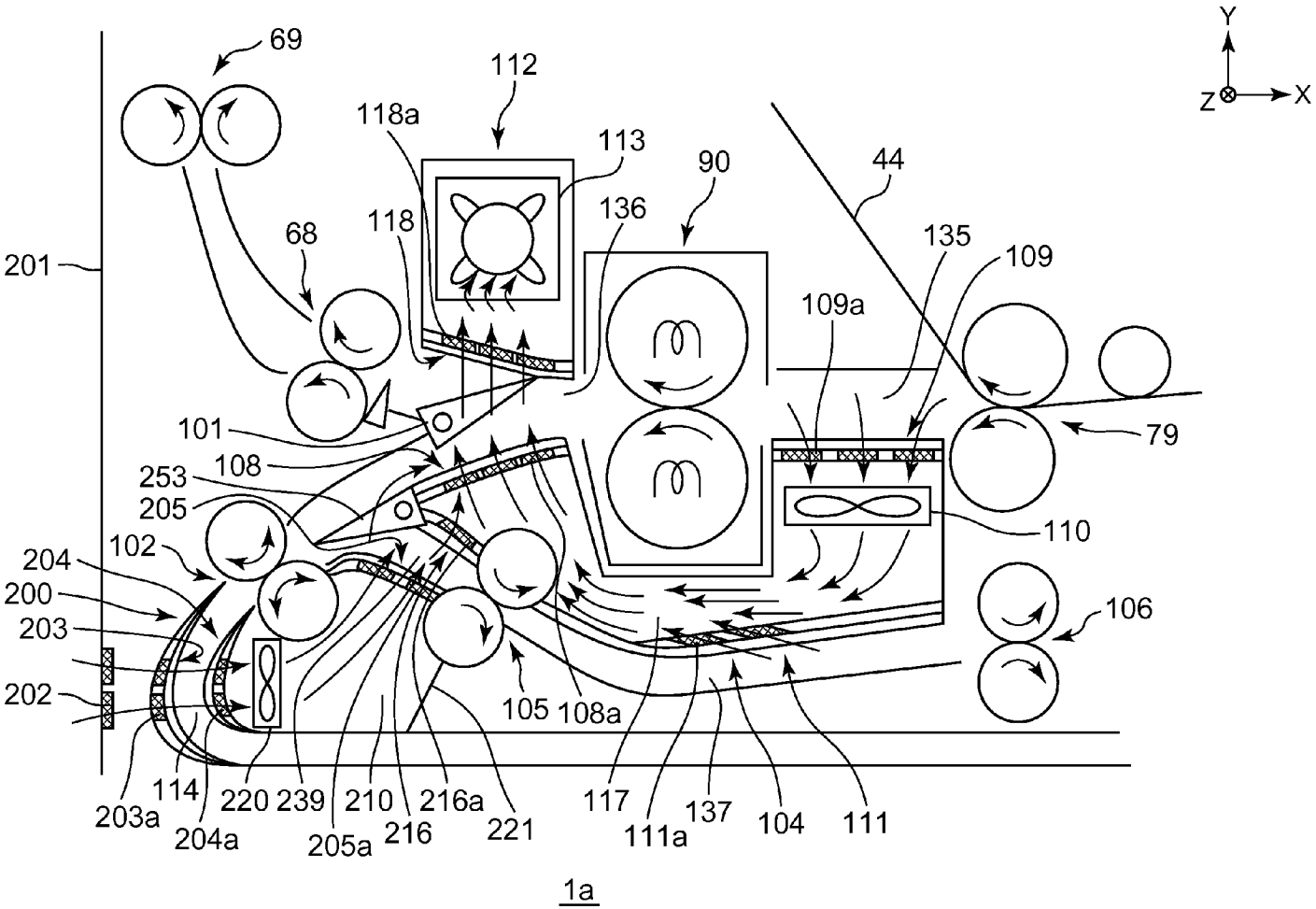
FIG. 10 is a schematic view showing the configuration of a fuser part and a double sided printing mechanism according to a second illustrative embodiment.

As shown in FIG. 10, the image forming apparatus 1*a* includes, for example, a double sided print carrying duct 210 and an external air suction fan 220 in addition to the configuration of the image forming apparatus 1 in the first embodiment. Common elements of structures between the image forming apparatus 1 and the image forming apparatus 1*a* may be designated by the same reference characters and be described by the same reference numbers. Thus, also referring to FIGS. 1 to 9, the common elements may be described hereinafter.

The double sided print carrying duct 210 is in the air and comprised of three side walls. The first side wall is an inner curved faced guide part 204 that forms a part of the retreating part 114 (FIG. 2), the second side wall is an inversion downside guide part 205 that forms a part of the inversion carrying path 116 (FIG. 2), and the third side wall is a side wall 221. The inner curved faced guide part 204 includes hole(s) 204*a*, and the inversion downside guide part 205 includes hole(s) 205*a*. Thus, the air in the retreating part 114 and/or the inversion carrying path 116 flows through the double sided print carrying duct 210. The external air suction fan 220 is provided in the double sided print carrying duct 210. The external air suction fan 220 sucks air through the hole(s) 204*a* to flow the air out via the hole(s) 205*a*.

The retreating part 114 includes an outer curved faced guide part 203, and the outer curved faced guide part 203 has hole(s) 203*a* that face the hole(s) 204*a*. A facing wall 201 of the image forming apparatus 1*a* has hole(s) 202 that face the hole(s) 203*a*. The inversion carrying path 116 includes an inversion upside guide part 216, and the inversion upside guide part 216 has hole(s) 216*a* that face the hole(s) 205*a*. The hole(s) 202 to 216*a* is equal to hole(s) that external air, and the double sided print carrying duct 210 and/or the external air suction fan 220 are equal to a flowing unit.

Each hole(s) and rib(s) of the outer curved faced guide part 203, the inner curved faced guide part 204, the inversion downside guide part 205, and the inversion upside guide part 216 may be provided by the same structures, for example, the hole(s) 108*a* and the rib(s) 108*b* of the fixing guide part 108 (FIG. 3) in the first embodiment. The width of location area of the hole(s) is also wider than the width of the recording medium 51 in the direction "Z".

As described about the ejection separator 101 (FIG. 6) above, an each guide part of an inversion separator 253 is formed at a set interval in the direction "Z", so the shape of the guide parts in the inversion separator 253 is a pectinate shape.

The air volume of the ejection fan 113 may be larger than the total air volume of the suction fan 110 and the external air suction fan 220.

The external air suction fan 220 sucks the external air through the hole(s) 202, 203*a*, and 204*a* to pull in the double sided print carrying duct 210. Next, the external air in the double sided print carrying duct 210 flows through the hole(s) 205*a* to the inversion carrying path 116.

Next, the external air in the inversion carrying path 116 flows through the hole(s) 216*a* to the duct 117. The air that flows by the suction fan 110 and the external air merges in the duct 117, and flows through hole(s) 108*a* and 118*a*. Next, the ejection fan 113 vents the merged air from the hole(s) 118*a* to the outside of the image forming apparatus 1*a*.

When the recording medium 51 passes through the retreating part 114 that is heated by the fixing unit 90, the external air cools the recording medium 51. Also, the air in the retreating part 114 that is heated and dry flows through the double sided print carrying duct 210, and the ejection fan 113 vents it to the outside.

The dry air in the retreating part 114 that is heated by the recording medium 51 and the dry air in the inversion carrying path 116 flow through the hole(s) 108*a* to the second carrying path 136 (FIG. 2) by the suction fan 110, the ejection fan 113, and the external air suction fan 220, and both the dry air flows through the hole(s) 118*a* to the ejection fan 113. Thus, the image forming apparatus 1*a* may get cool more effectively than the first embodiment.

There is a set interval between the external air suction fan 220 and a carrying surface of the inner curved faced guide part 204. And more, the width of location area of the hole(s) 203*a*, 204*a*, 205*a*, and 216*a* is wider than the width of the recording medium 51 in the direction "Z". Thus, the air flows through the hole(s) 203*a*, 204*a*, 205*a*, and 216*a* to the duct 210 although the recording medium 51 travels on the each guide part 203, 204, 205, and 216. As described about ejection separator 101 above, the inversion separator 253 also has gaps between guide parts, and the air flows through the gaps. Thus, the air from the hole(s) 205*a* may flow to the second carrying path 136.

The image forming apparatus 1*a* may improve stable traveling for the recording medium 51 in the first carrying path 135, and may exhaust heat in the third carrying path 137. And, the image forming apparatus 1*a* may stop condensation and get cool in it more effectively. The image forming apparatus 1*a* vents the air that includes vapor to the outside, even though the air in the down part of the fixing guide part 108 includes much more vapor than a normal situation.

The hole(s) 108*a*, 109*a*, and 111*a* and the rib(s) 108*b*, 109*b*, and 111*b* may be equal to or more than one in the duct 117, and the hole(s) 203*a*, 204*a*, 205*a*, and 216*a* and the rib(s) may be equal to or more than one in the double sided print carrying duct 210. If the air flows through the hole(s) 108*a* to 216*a*, shape(s) and location(s) of the hole(s) 108*a* to 216*a* are not limited to the description in the first and second embodiments.

The suction fan 110, the ejection fan 113, and the external air suction fan 220 include one or more blades to flow the air. However, at least one of the suction fan 110, the ejection fan 113, or the external air suction fan 220 may flow the air without blades.

The image forming apparatus 1 and 1*a* may be the image forming apparatus for the intermediate transfer method. However, the image forming apparatus 1 and 1*a* are not limited to the intermediate transfer method, for example, image forming apparatus 1 and 1*a* may be the image forming apparatus for the direct transfer method.

The image forming apparatus 1 and 1*a* may be the electrographic system of color and/or black-and-white. However, the image forming apparatus 1 and 1*a* are not limited to the electrographic system of them, for example, the image forming apparatus 1 and 1*a* may be a copy device, a fax device, a MFP (Multifunction Printer, Peripheral, or Product).

While the foregoing has particularly shown and described with reference to certain specific embodiments, it will be understood by those skilled in the art that the foregoing and other changes in form and details can be made therein without departing from the spirit and scope of the appended claims.

What is claimed is:

1. An image forming apparatus, comprising:

a transfer unit configured to transfer an image that is formed by an image forming portion to a sheet;

a fixing unit configured to fix the transferred image to the sheet;

a first carrying path in which the sheet is carried from the transfer unit to the fixing unit;

a second carrying path in which the sheet carried from the fixing unit is carried in a predetermined direction;

an air way configured to connect the first carrying path and the second carrying path; and an air flowing unit configured to flow air from the first carrying path into the second carrying path through the air way.

2. The image forming apparatus of claim 1, further comprising an venting unit configured to vent the air in the second carrying path to an exterior of the image forming apparatus.

3. The image forming apparatus of claim 2, wherein:

the first carrying path includes a first guide that has a first hole, the second carrying path includes a second guide that has a second hole, the second carrying path includes a third guide that has a third hole and faces the second guide, the air way connects the first carrying path and the second carrying path through the first hole and the second hole, and the venting unit vents the air through the third hole.

4. The image forming apparatus of claim 3, further comprising a third carrying path in which the sheet is carried from the second carrying path to the first carrying path.

5. The image forming apparatus of claim 4, wherein the third carrying path includes a fourth guide part that has a fourth hole

6. The image forming apparatus of claim 5, wherein the air in the third carrying path is flowed into the air way through the fourth hole.

7. The image forming apparatus of claim 4, further comprising an external air flowing unit configured to flow the external air into the air way.

8. The image forming apparatus of claim 3, wherein the first hole is formed in a sheet carrying area in the first guide.

9. The image forming apparatus of claim 3, wherein the second hole is formed in a sheet carrying area in the second guide.

10. The image forming apparatus of claim 3, wherein the third hole is formed in a sheet carrying area in the third guide.

11. The image forming apparatus of claim 5, wherein the fourth hole is formed in a sheet carrying area in the fourth guide.

12. The image forming apparatus of claim 3, wherein the first guide includes a rib which is formed near the first hole.

13. The image forming apparatus of claim 3, wherein the second guide includes a rib which is formed near the second hole.

14. The image forming apparatus of claim 3, wherein the third guide includes a rib which is formed near the third hole.

15. The image forming apparatus of claim 5, wherein the fourth guide includes a rib which is formed near the fourth hole.

16. The image forming apparatus of claim 5, wherein the air flowing unit is arranged away from the first guide.

17. The image forming apparatus of claim 5, further comprising:

a separator is arranged between the second guide and the third guide, wherein the separator includes a fifth guide for guiding the sheet and a fifth hole.

18. The image forming apparatus of claim 1, wherein the air way is formed by a duct.

* * * * *